US008250982B2

(12) United States Patent
Kothe et al.

(10) Patent No.: US 8,250,982 B2
(45) Date of Patent: Aug. 28, 2012

(54) PYROTECHNIC SIGNALING MEANS

(75) Inventors: Thorsten Kothe, Achim (DE); Ernst Dix, Bremerhaven (DE)

(73) Assignee: Chemring Defence Germany GmbH, Bremerhaven (DE)

( * ) Notice: Subject to any disclaimer, the term of this patent is extended or adjusted under 35 U.S.C. 154(b) by 523 days.

(21) Appl. No.: 12/237,860

(22) Filed: Sep. 25, 2008

(65) Prior Publication Data

US 2009/0090264 A1 Apr. 9, 2009

(30) Foreign Application Priority Data

Oct. 4, 2007 (DE) ..... 10 2007 047 581
Nov. 6, 2007 (DE) ..... 10 2007 052 728

(51) Int. Cl.
*F42B 4/26* (2006.01)

(52) U.S. Cl. ..... 102/336; 102/341

(58) Field of Classification Search ..... 102/334, 102/335, 341, 336, 361
See application file for complete search history.

(56) References Cited

U.S. PATENT DOCUMENTS 2,807,208 A * 9/1957 Mckown ..... 102/336
4,846,067 A * 7/1989 Martin ..... 102/275.6
5,313,888 A * 5/1994 Martin ..... 102/334
5,526,751 A * 6/1996 Spivey et al. ..... 102/341

* cited by examiner

*Primary Examiner* — James Bergin
(74) *Attorney, Agent, or Firm* — Laurence P. Colton; Smith Risley Tempel Santos LLC

(57) ABSTRACT

Pyrotechnic signaling means (10) are ignited manually by pulling on a pulling member (24). In known pyrotechnic signaling means (10), the pulling member (24) has a short cable which is knotted to an operating means (26). A knot such as this can be produced only manually, thus making the production of pyrotechnic signaling means (10) quite complex. In addition, an ignition device (14) for known pyrotechnic signaling means (10) has a hole through it for a firing bolt (36) which is connected to the pulling member (24). This allows moisture to enter the pyrotechnic signaling means (10) through the ignition device (14). The pyrotechnic signaling means (10) according to the invention provides for the pulling member (24) to be formed from flexible strip-like sections (48, 50), which are connected by film hinges (54) and can be collapsed, saving space, when not in use. The sections (48, 50) can be integrally connected to an operating means (46), such that the entire pulling member (24) can be formed integrally from plastic and manual fitting of the individual components of the pulling member (24) is superfluous. The invention also provides for the ignition device (14) to be sealed by a coupling device (42) of the pulling member (24) until the pyrotechnic signaling means (10) are activated. This means that no moisture can pass through the ignition device (14) before the pyrotechnic signaling means (10) are activated.

18 Claims, 7 Drawing Sheets

PYROTECHNIC SIGNALING MEANS

STATEMENT OF RELATED APPLICATIONS

This patent application is based on and claims the benefit under 35 USC 119 of German Patent Application No. 10 2007 047 581.2 having a filing date of 4 Oct. 2007 and German Patent Application No. 10 2007 052 728.6 having a filing date of 6 Nov. 2007, both of which are incorporated herein in their entireties by this reference.

BACKGROUND OF THE INVENTION

1. Technical Field

The invention relates to a pyrotechnic signaling means having at least one pyrotechnic effect charge and an ignition device, it being possible for the ignition device to be activated by a pulling member. The invention also relates to a pyrotechnic signaling means having at least one pyrotechnic effect charge, which is arranged in a casing, an ignition device, which is associated with one end face of the casing, and a pulling member for activation of the ignition device.

2. Related Art

Pyrotechnic signaling means are normally used to indicate acute emergency situations in aviation and maritime applications, for example. In addition, pyrotechnic signaling means can also be used for illumination purposes.

Pyrotechnic signaling means have at least one pyrotechnic effect charge which can be used in particular for signaling and/or illumination purposes. For this purpose, the effect charge in the respective pyrotechnic signaling means is normally ignited with the aid of an ignition device. The ignition device is activated manually by pulling on a pulling member. In order to allow convenient and safe handling, known pyrotechnic signaling means have a pulling member which is formed by a short cable. During production of the pyrotechnic signaling means, the cable of the ignition device must be manually knotted to the operating means. This makes the assembly process more complex and expensive, and it also involves hazards to the person carrying out the assembly process, because of the pyrotechnics that are used.

BRIEF SUMMARY OF THE INVENTION

The object of the invention is to provide a pyrotechnic signaling means which can be produced more easily, in particular which allows largely automated production, and which complies with the technical requirements.

A pyrotechnic signaling means to achieve this object is characterized in that the pulling member has sections which are connected to one another in an articulated manner. A pulling member such as this for activation of the ignition device can be produced by machine. This accordingly simplifies and rationalizes the production of pyrotechnic signaling means according to the invention.

The pulling member preferably has a plurality of sections. The individual sections of the pulling member are connected to one another by articulated connections, in particular hinges. This refinement allows the individual sections of the pulling member to be collapsed or folded up, in such a way that the pulling member can be accommodated in a space-saving manner, but in the unfolded state may have more than the length of a cable which is used for known pyrotechnic signaling means.

In particular, the pulling member according to the invention has outer sections and inner sections which are connected to one another like hinges, to be precise preferably integrally.

In order to allow space-saving central storage and a uniform force distribution when the pulling member is activated, at least one outer section may be shorter than one or more inner sections of the pulling member. In this case, any desired number of sections, but preferably between two and ten sections, which are connected to one another can be associated with the pulling member. The inner sections of the pulling member preferably have the same length, thus allowing the folded-up arrangement of the pulling member to be spatially compact. The two outer sections, which are arranged at the respective ends of the sections which are connected to one another in an articulated manner, are preferably half as long as the inner sections located between them. This therefore allows a compact, space-saving stack of all the sections to be formed by folding up the sections, with a base area which is preferably essentially rectangular or in the form of a strip.

One particularly preferred embodiment of the pulling member has at least some inflexible sections. The sections which are in the form of strips are in this case in the form of essentially rigid or stiff sections between the articulated or hinge-like connections. The pulling member can thus be collapsed or folded up like a concertina when not being used. In this case, the sections may nevertheless have slight elasticity in order to allow safe and convenient handling of the pulling member in that peak loads on activation by pulling on the pulling member are damped or sprung.

In a further refinement of the invention, the articulated or hinge-like connections between at least some sections of the pulling member which are in the form of strips are designed such that they unfold the collapsed pulling member at least partially automatically after release. In consequence, the pulling member is automatically changed before use to an at least partially extended, elongated form. The pulling member can then also be deliberately gripped by an operator, for example when wearing thick gloves, and the pyrotechnic signaling means can thus be activated without problems and safely even in poor conditions.

The pulling member can preferably have at least one associated initiation means for the ignition device. An initiation means such as this is used to activate the ignition device, thus allowing the pyrotechnic signaling means to be operated. A firing bolt and/or a friction fuse can preferably be provided as the initiation means; however, the invention is not restricted to this because other suitable initiation means can also be used. In order to activate a firing bolt, the firing bolt normally has an associated spring, in particular a compression spring, which, after pulling on the firing bolt and then releasing it, allows the stored energy to be converted to kinetic energy of the firing bolt in order to activate the ignition device, in particular by firing a firing cap. A friction fuse, which can alternatively be used, activates the ignition device directly by the heat which is created when it is pulled out.

In particular, a pulling member according to the invention furthermore has at least one coupling device which can be connected to the initiation means. In order to ensure that the pulling member is highly flexible, the pulling member and the at least one coupling device are preferably connected to one another in an articulated manner, in particular like a hinge.

The connection between the coupling device and the initiation means is preferably disconnectable or detachable in order that the coupling device, which is located together with the pulling member, can release the initiation means, in order to activate the ignition device, when the pulling member is operated. The connection between the coupling device and the initiation means is preferably produced by mutually corresponding attachment means. By way of example, these may be elements which engage in one another in an interlocking manner, such as projections, hooks or the like. Adhesive means can likewise also be provided to produce the connection. Since the connection is disconnectable or detachable, the initiation means can be released from the coupling device, after pulling on the pulling member, in order to activate the ignition device.

The coupling device is furthermore preferably connected to the pulling member in an articulated manner. This is intended to give the pulling member the flexibility which is required for safe handling and for space-saving accommodation.

In particular, the coupling device has at least one projection and/or at least one depression which can be engaged with at least one corresponding projection or at least one depression of the initiation means. The respective projection or respective depression of the coupling device and of the initiation means are designed to correspond to the extent that they are used to make a detachable connection between the coupling device and the initiation means, in that the initiation means can be cocked by operation of the pulling member, and can then be pulled out of the ignition device.

The coupling device can have either a single-part or multipart configuration. In a preferred embodiment, the coupling device is formed from two parts. These parts can be two halves which are configured in an identical or similar manner, and which in particular are able to fit one another as well as, if necessary, the corresponding initiating means in a positive-locking manner, in particular when the parts of the coupling device are in their folded-up state. The parts of the coupling device are preferably connected to one another in an articulated manner in that at least one hinge or the like is provided between them. In particular, the individual parts of the coupling device can also be connected in articulated fashion to the pulling member.

The pulling member preferably has an operating means which is used for handling the pulling member. An operating means such as this may, for example, be in the form of a handle, knob, gripping ring or the like, in order to allow safe and convenient handling of the pulling member. The operating means is furthermore preferably connected to an outer element of the pulling member in an articulated manner, so as to allow the pulling member to be operated with the aid of the operating means at one end of the pulling member.

In one preferred embodiment, the operating means has at least one cutout for holding at least some collapsed sections and/or parts of at least some of the collapsed sections of the pulling member. The cutout in the operating means is preferably arranged in the area of the sections of the pulling member. This cutout is used for space-saving and protective accommodation of at least a part of the pulling member, such that it is possible to minimize the space required for an ignition device according to the invention until the pyrotechnic signaling means are used.

The entire pulling member is preferably formed integrally. In particular, however, the sections, the operating means and the coupling device may also be formed integrally as a unit, either in each case or in various combinations. In this case, plastic is preferably used as the material, although other suitable materials can also be used.

Particularly when the pulling member, the operating means and the coupling device are produced from plastic, all of the articulated connections can be formed by film hinges. The relevant articulated connections are located at least between the individual sections, in the area of the articulated connections of the pulling member, and preferably also between the outer sections and the operating means on the one hand, and the coupling means on the other hand. This allows the entire pulling member including the film hinges for connection of the components of the pulling member to be produced jointly, in one piece.

According to one advantageous refinement of the invention, the film hinges are designed such that they are elastically prestressed when the sections of the pulling member are collapsed or folded up. This prestressing is carried out in the sense that at least some of the sections of the pulling member are unfolded automatically by the film hinges, by reversing the elastic prestressing of the film hinges. In this case, the elements of the pulling member can be unfolded sufficiently far that they are entirely or at least partially unfolded. In the completely unfolded state, the longitudinal axes of the elements would then lie approximately on a common held line, resulting in the pulling member automatically assuming its maximum or approximately maximum length.

A further pyrotechnic signaling means in order to achieve the stated object is characterized in that the ignition device can be sealed by the ignition member. This may also be a development of the previously described pyrotechnic signaling means. This pyrotechnic signaling means is distinguished by an ignition device which can be sealed from the pulling member. This means that no water can pass through the ignition device into the pyrotechnic signaling means before activation of the ignition device.

Since pyrotechnic signaling means are used inter alia in the aviation and maritime field, water-tightness is important, and in some countries is even legally required, in order that the signaling means operate reliably even after contact with water spray, or even after briefly being immersed in water.

In one preferred refinement of the invention, the ignition device has a holder in that end area of the initiation means which is associated with the pulling member or the coupling device. For example, this holder may be in the form of a cylindrical opening, or else may have some other shape.

The coupling device and the holder are preferably designed such that the coupling device can be held entirely or partially by the holder. In particular, the cross section of the coupling device fits into the holder. If the holder has a cylindrical cross section, the coupling device can be inserted into the holder with its longitudinal axis in any desired orientation, and it may even be possible to rotate it. Alternatively, other shapes, such as at least triangular basic shapes, are feasible, particularly if protection against twisting is desired.

In one preferred embodiment, the coupling device which is associated with the pulling member seals the holder such that it is at least liquid-tight for as long as the pulling member has not yet been operated. The holder and/or the coupling device may have one or more associated seals for better sealing, or they may have sealing seats. When the pyrotechnic signaling means is activated, the seal is broken. In particular, a knock-out for the initiation means in the end of the holder is released. Once the pyrotechnic signaling means has been activated, gases can then escape to the exterior from the interior of the casing of the pyrotechnic signaling means through the knock-out and the holder. Once the pyrotechnic signaling means has been activated, there is no longer any need for sealing against the ingress of liquids.

The coupling device is particularly preferably held in the holder of the ignition device by means of a prestressed spring, with the spring being associated with the initiation means, in particular a firing bolt. The spring prestressing results in a slight pressure being exerted on the coupling device, which is located in the holder of the ignition device, thus resulting in better sealing of the ignition device, to be precise possibly without any separate seal.

The initiation means can advantageously be released by the parts of the coupling device being unfolded, when the pulling member is operated, since the coupling device is then pulled out of the holder. It is thus possible for the parts of the coupling device to be able to move freely laterally in order to fold apart from one another, which is not possible within the holder, because of the guidance of the coupling device at the side. The initiation means is therefore released at the same time, and the seal of the ignition device is broken.

BRIEF DESCRIPTION OF THE DRAWINGS

One preferred exemplary embodiment of the invention will be explained in the following text with reference to the drawing, in which.

DETAILED DESCRIPTION OF PREFERRED EMBODIMENTS

Figure 1:
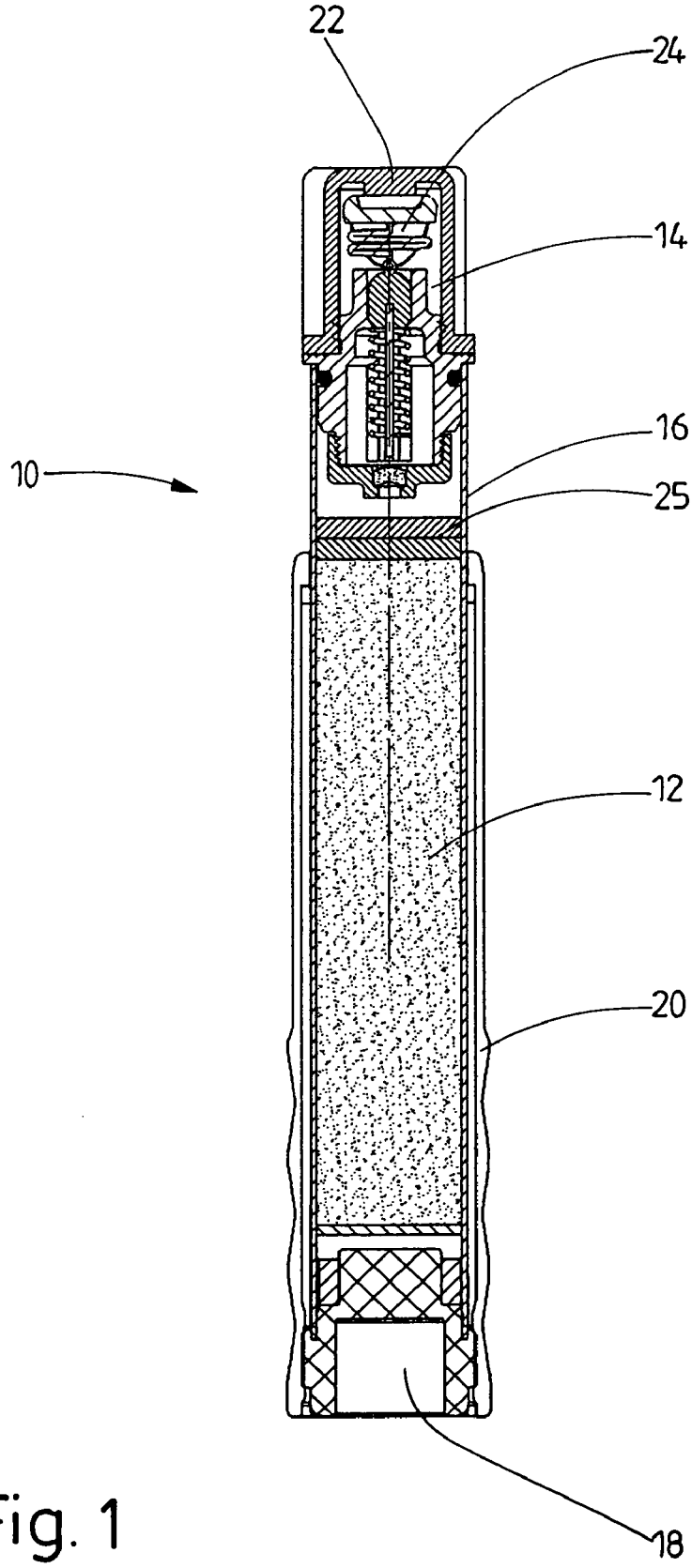
FIG. 1 shows a longitudinal section through a pyrotechnic signaling means according to the invention.
Figure 2:
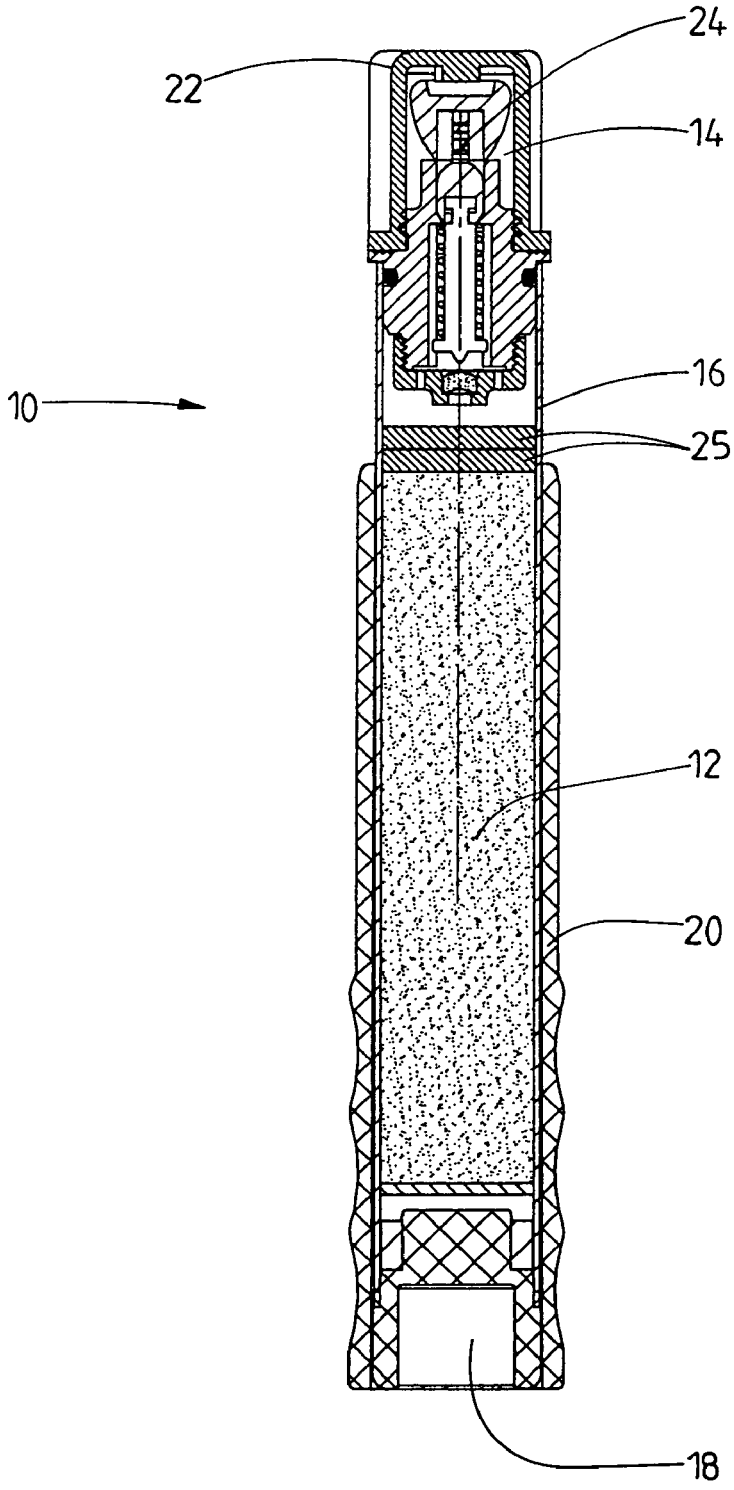
FIG. 2 shows a further longitudinal section through a pyrotechnic signaling means according to the invention, along a section plane rotated through 90° with respect to the section plane shown in FIG. 1.

FIGS. 1 and 2 show longitudinal sections through the entire pyrotechnic signaling means 10 according to the invention. The pyrotechnic signaling means 10 has an ignition device 14 which closes one end of a casing 16, while the other end of the casing 16 is closed by a holder 18. A pyrotechnic effect charge 12 is arranged within the casing 16. If required, a plurality of effect charges and/or a parachute can also be arranged in the casing 16. For ease of handling and in order to avoid any hazard to the operator from the burning pyrotechnic effect charge 12, a handle casing 20, which surrounds the casing 16 over at least part of its length, is arranged outside the casing 16 and can be pulled out with respect to the casing 16 in order to increase the distance between the operator and the activated pyrotechnic effect charge 12. The handle casing 20, like the holder 18 as well, can preferably be manufactured from plastic, in particular from a thermoplastic, and can preferably be colored with a signal color, for example orange.

The ignition device 14 is closed in a liquid-tight manner by a cover 22. A pulling member 24 for activation of the ignition device 14 is arranged within this cover 22. The pulling member 24 shown here is used as a manual release for manual initiation of the pyrotechnic signaling means 10.

A relay 25 is arranged in the area of the pyrotechnic effect charge 12 facing the ignition device 14. The relay 25 is ignited by the ignition device 14 and produces sufficient energy for reliable ignition of the pyrotechnic effect charge 12. In addition, the relay 25 may also have an associated pyrotechnic delay, which results in delayed activation of the relay and therefore in delayed ignition of the pyrotechnic effect charge 12.

FIGS. 3 to 7 show, in detail, the ignition device 14 of the pyrotechnic signaling means 10. The cover 22 can also be seen in FIGS. 3 and 4 and is screwed in a liquid-tight manner to a base 28 of the ignition device 14, with the aid of a thread 26. The base 28 is inserted into an end area of the casing 16 and is sealed with respect to the casing 16 by means of an O-ring 30. The lower part of the base 28 is connected to a bottom part 32, in which a firing cap 34 is located. An aperture hole, which is formed from a plurality of different sections, is arranged centrally in the base 28. A firing bolt 36 is arranged within the base 28 in this aperture hole, on the longitudinal center axis of the latter, and is used to fire the firing cap 34. In order to ensure that sufficient kinetic energy is available to activate the firing cap 34, the firing bolt 36 has an associated spring 38 which surrounds it and which, in the illustrated exemplary embodiment, is a compression spring. The upper end of the spring 38 is supported on the base 28, and its lower end is supported on the firing bolt 36. The upper end area of the firing bolt 36 projects through an opening in the base 28 into a holder 40.

The holder 40 is arranged in the base 28 and is used to store a part of the pulling member 24, specifically a coupling device 42. This coupling device 42 is detachably connected to the firing bolt 36 and, when it has not yet been activated, seals the holder 40 of the base 28 in a liquid-tight manner so that no liquid can pass through the holder 40 from the outside into the internal area 41 of the ignition device 14. The base 28 of the ignition device 14 is sealed in the area of the firing bolt 26 by a sealing seat 43 between the coupling device 42 and the holder 40 in the base 28. In the illustrated exemplary embodiment the sealing seat 43 is in the form of a truncated cone. In the uninitiated state, the firing bolt 36, which is still connected to the coupling device 42, is prestressed by the spring 38 such that it presses the coupling device 42 against the sealing seat 43 on the base 28. This results in the base 28 of the ignition device 14 being sealed in a liquid-tight manner in the area of the firing bolt 36, without any need for an additional seal. As a result of the truncated-conical shape of the sealing seat 43, prestressing of the firing bolt 36 results in the truncated-conical sealing surface being pressed against the lower face of the coupling device 42, forming a seal against the corresponding truncated-conical sealing surface at the lower end of the holder 40 in the base 28 of the ignition device 14. This truncated-conical sealing surface at the lower end of the holder 40 surrounds a section, which is adjacent to the holder 40, of the aperture hole for the firing bolt 36 in the base 28.

Two openings 44 are arranged in the bottom part 32 and connect the internal area of the ignition device 14, specifically the aperture hole in the base 28, to the internal area of the casing 16 with the pyrotechnic effect charge 12.

In addition to the coupling device 42, the pulling member 24, which is formed from plastic, comprises an operating means 46 and a plurality of sections 48 and 50. The sections 48 and 50 are connected to one another by means of hinges. The coupling device 42 is likewise connected to a free end of an outer section 48 by means of a hinge. The operating means 46 is also connected via a hinge to a free end of an opposite outer section 48. In the illustrated exemplary embodiment, all of the hinges are in the form of film hinges 54. This allows the entire pulling member 24 to be formed integrally from plastic, in particular thermoplastic.

Figure 3:
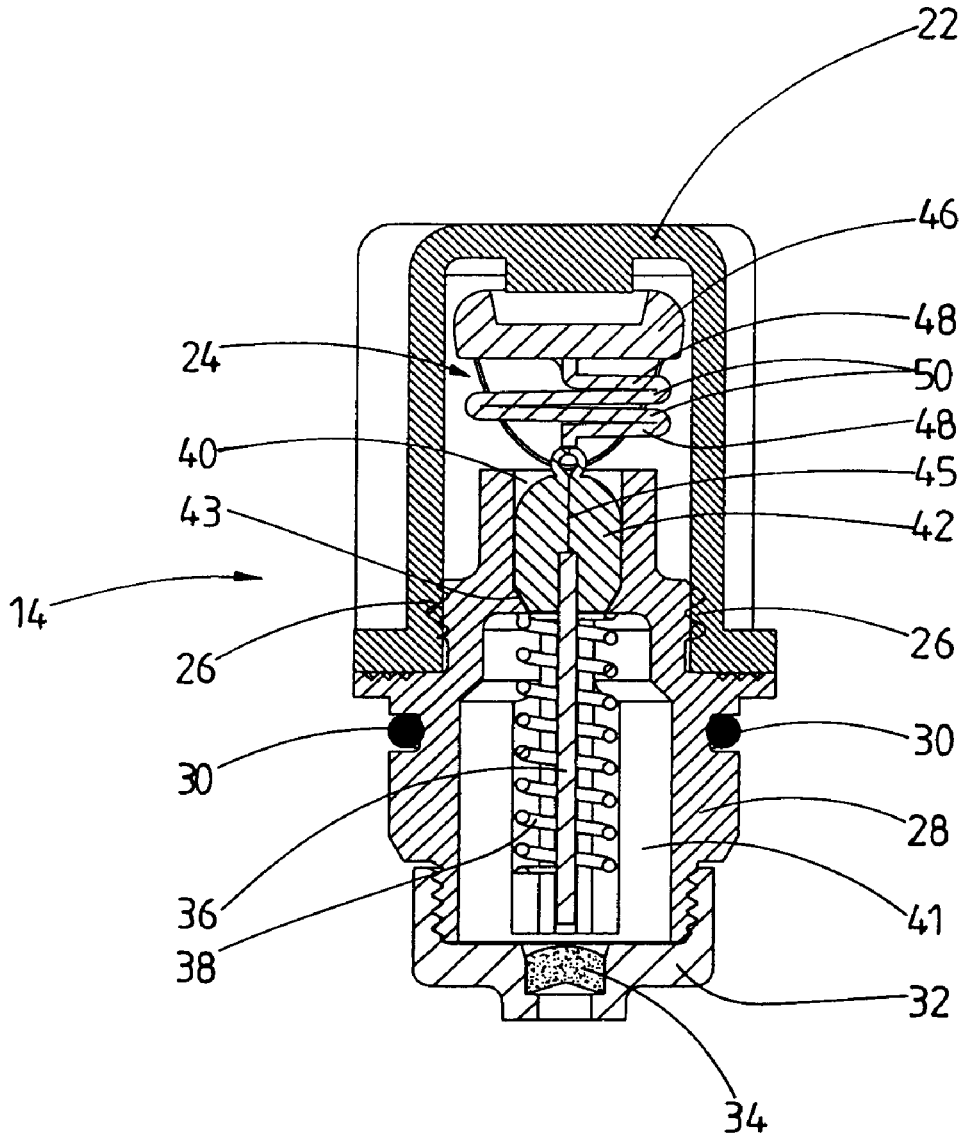
FIG. 3 shows an enlarged illustration of an ignition device in the form of a longitudinal section as in FIG. 1.
Figure 4:
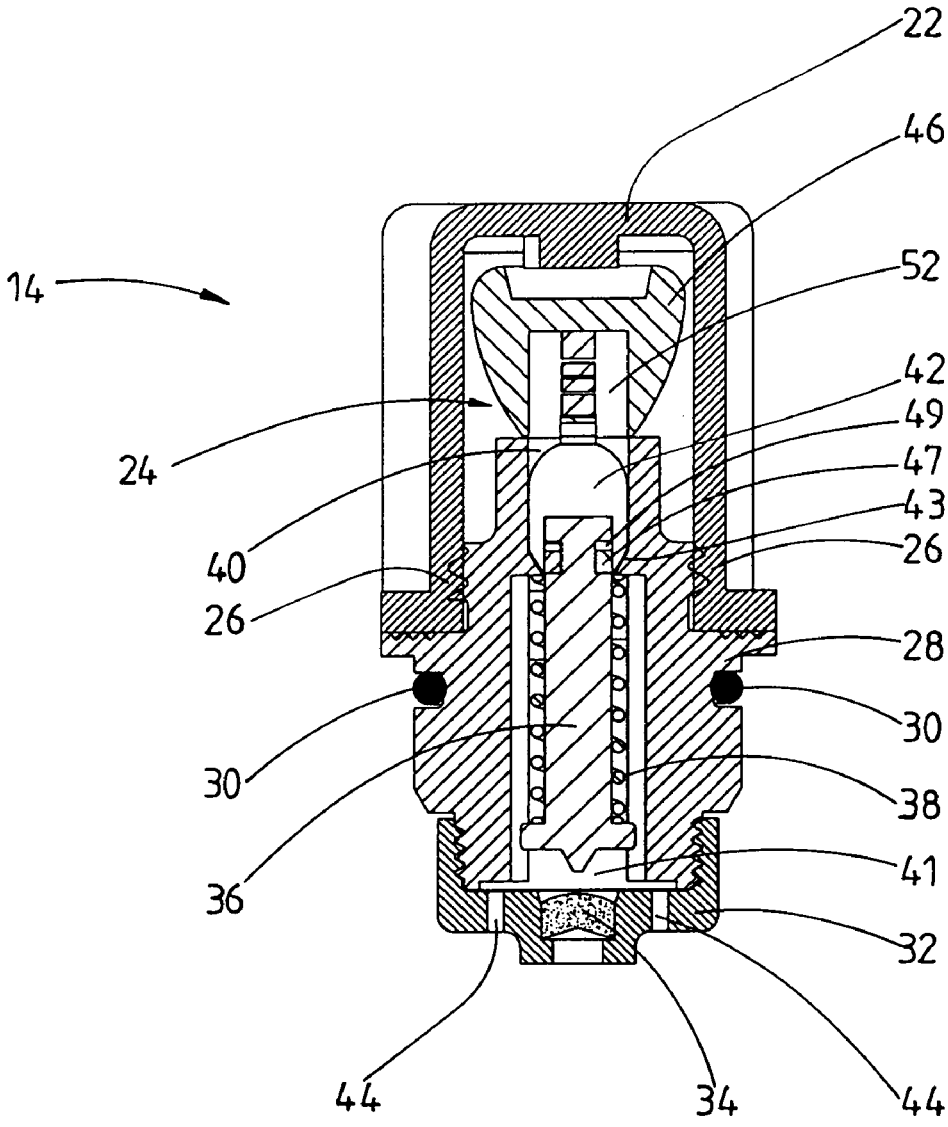
FIG. 4 shows an enlarged illustration of an ignition device in the form of a longitudinal section as in FIG. 2.

The sections 48 and 50 of the pulling member 24 are inflexible, and in particular relatively inflexible. The sections 48 and 50 are in the form of thin strips with a rectangular cross section. Two inner sections 50 and two outer sections 48 are provided in the illustrated pulling member 24, which are each connected to one another by means of a film hinge 54, and are thus linked. However, the invention is not restricted to four sections 48, 50. The outer sections 48 are shorter than the inner sections 50, which are of the same length and are arranged in between. In the illustrated exemplary embodiment, the outer sections 48 are each only approximately half as long as the inner sections 50. In consequence, when the sections 48 and 50 are folded up, the coupling device 42, which is arranged at the free ends of the outer sections 48 such that it can be moved by means of film hinges 54, and the operating means 46 are located approximately centrally between the operating means 46 and the coupling device 42, as can be seen in FIG. 3. FIG. 3 also shows that the operating means 46 has a cutout 52 in the end facing the coupling device 42, in which cutout 52 the majority of the sections 48 and 50 is held in the collapsed state, thus allowing the operating means 46 to be brought into contact with the base 28, as a result of which the pulling member 24 can be accommodated, before activation of the pyrotechnic signaling means 10, in a space-saving manner in the cover 22 which is screwed to the base 28 of the ignition device 14.

Figure 5:
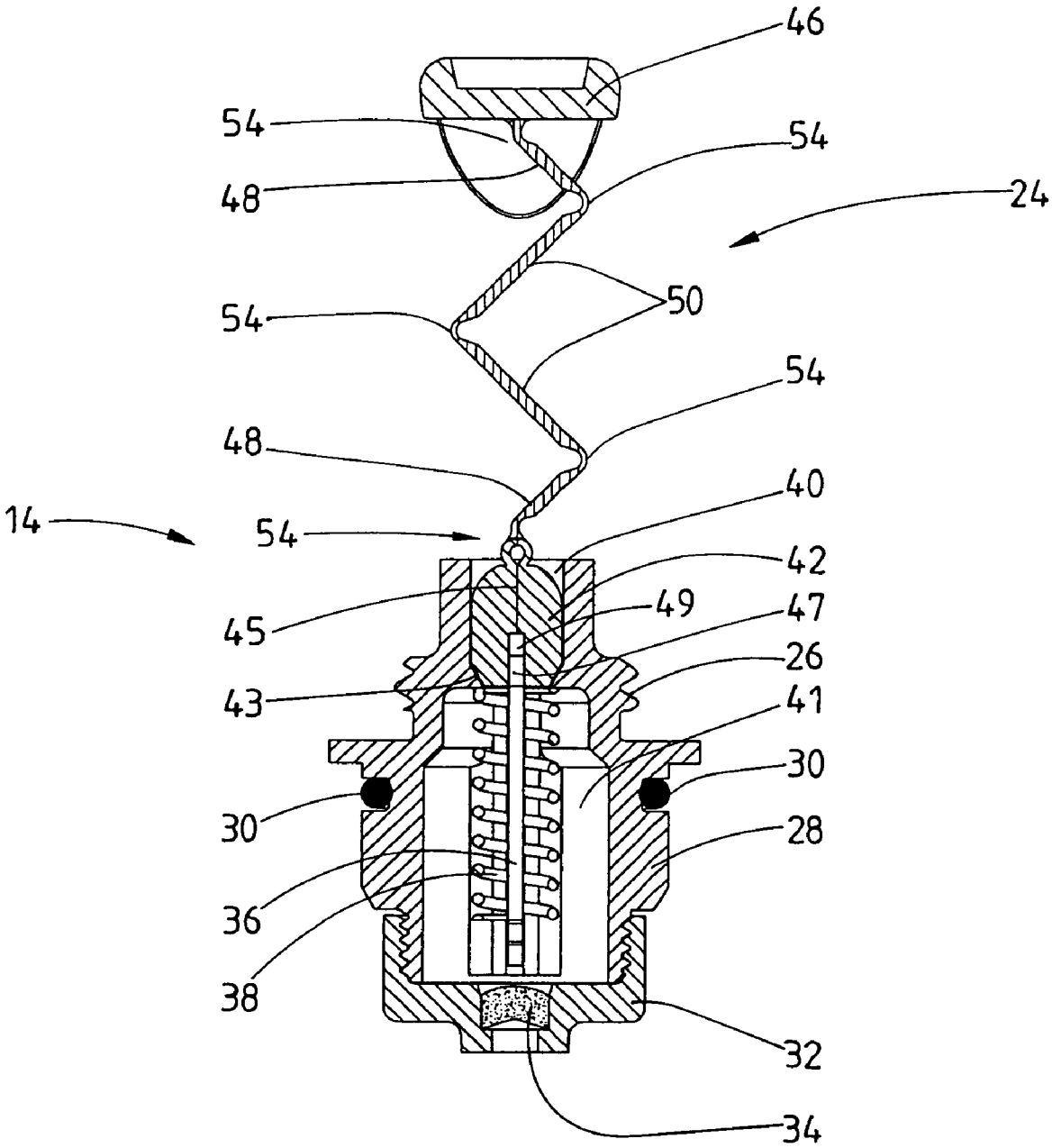
FIG. 5 shows an illustration of the ignition device, analogously to FIG. 3, with the pulling member partially unfolded.

When the pulling member 24 is in the collapsed state as shown in FIG. 3, at least the film hinges 54 between adjacent sections 48 and 50 are elastically prestressed. They are prestressed in such a way that, after the cover 22 has been unscrewed from the base 28 of the ignition device 14, the pulling member 24 can be unfolded automatically, as is illustrated in FIG. 5. The film hinges 54 in this case pivot respectively adjacent sections 48, 50 apart from one another in opposite directions, thus lengthening the pulling member 24. In contrast to the illustration shown in FIG. 7, the spring prestressing of the film hinges 54 may also be sufficiently great that it unfolds the sections 48 and 50 even further than shown in FIG. 7, to be precise possibly so far that the pulling member 24 is completely or essentially completely stretched out, and all the sections 48, 50 lie at least virtually on a line.

The coupling device 42 is formed from two identical halves. The halves are designed to correspond to one another such that the coupling device 42 results in a cylindrical shape when the halves are located on one another, and can then be inserted into the cylindrical holder 40 at the lower end of the base 28. In the process, a separating plane 45 runs between the two halves of the coupling device 42 on the longitudinal center axis of the ignition device 14, on which firing bolts 36 can be pulled up by the coupling device 42. The two halves of the coupling device 42 are connected at their upper ends facing the operating means 46 by means of a film hinge 54 which is at the same time used to connect the outer section 48, located underneath, of the pulling member 24 to the coupling device 42 in an articulated manner. This lower film hinge 54 therefore integrally connects three parts to one another. Each half of the coupling device 42 has projections 47 which engage in corresponding recesses 49 at the upper end of the firing bolt 36 as long as the coupling device 42 is still inserted in the holder 40 in the base 28, as a result of which the two halves of the coupling device 42 are held together by the cylindrical holder 40, as is illustrated in FIG. 3. But as an alternative, the coupling device 42 can also have just one part which corresponds to the firing bolts 36 and which is connected to the pulling member in an articulated manner.

Figure 6:
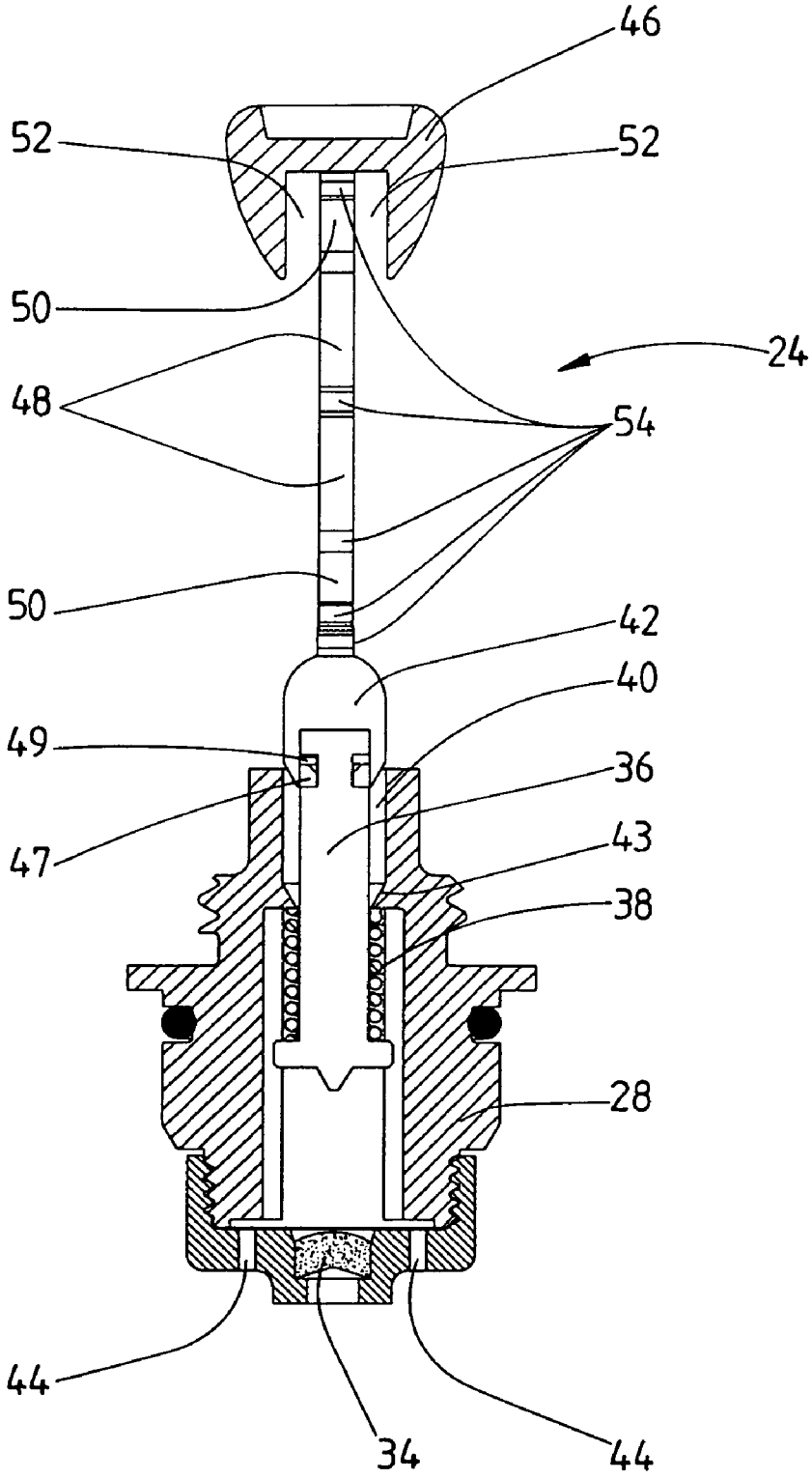
FIG. 6 shows an illustration of the ignition device, analogously to FIG. 4, with the pulling member partially unfolded.

FIG. 5 shows the ignition device 14 from the side, with the pulling member 24 partially unfolded. The coupling device 42 of the pulling member 24 is still located in the holder 40 in the ignition device 14, in order to seal this in a water-tight manner on the sealing seat 43. The operating means 46 of the pulling member 24 has been pulled upwards, such that it has been possible for the inner sections 48 and the outer sections 50 to unfold. FIG. 6 shows the unfolded pulling member 24 from the front, in such a way that the outer sections 48 and the inner sections 50 lie on a line. The cutout 52 in the operating means 46 for holding the sections 48 and 50 is in this case shown in the form of a cross section. Furthermore, FIG. 6 shows the pulling member 24 extended and the coupling device 42 pulled virtually completely out of the holder 40, as a result of which the firing bolt 36 has been pulled upwards, and the spring 38 has thus been loaded.

Figure 7:
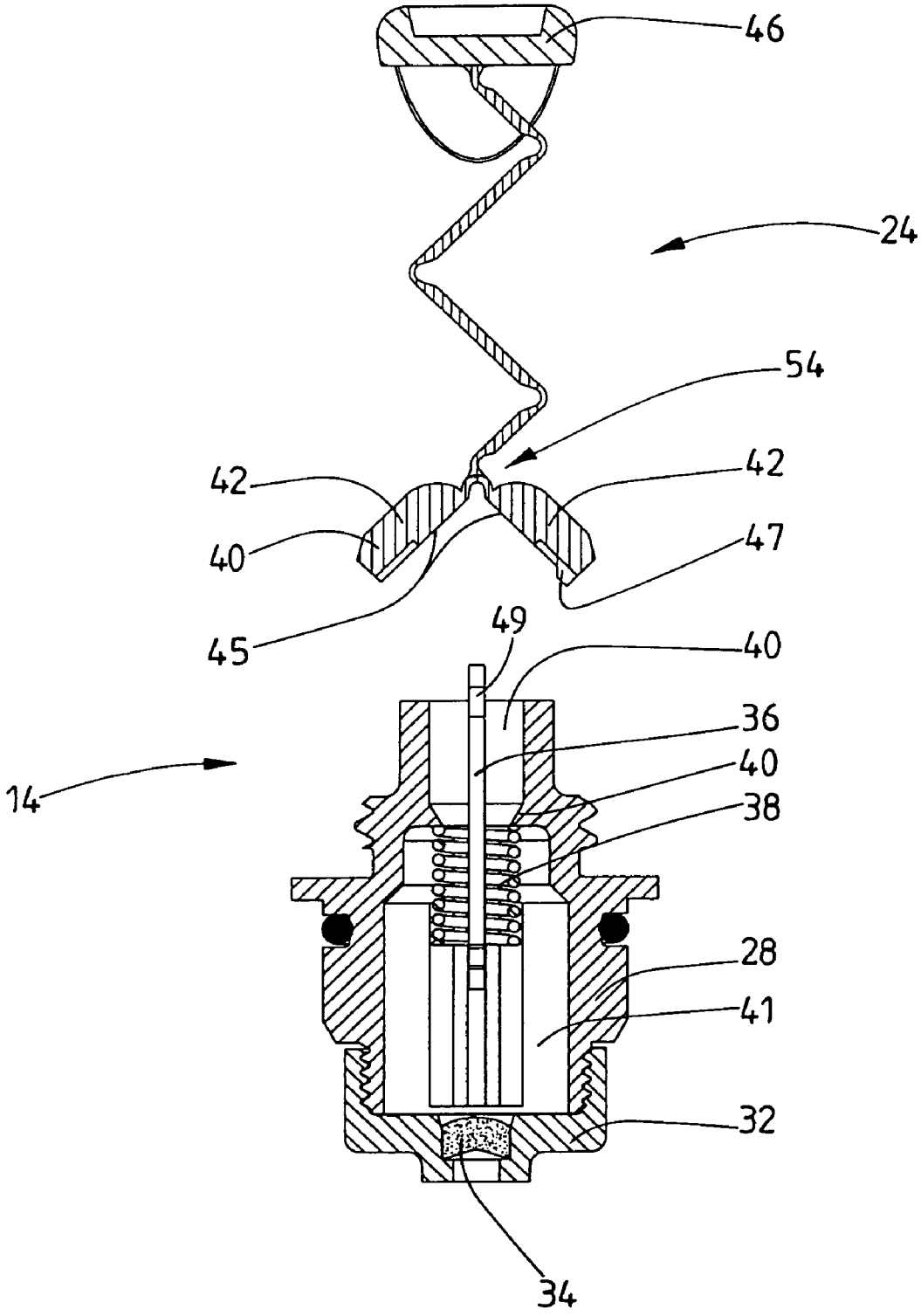
FIG. 7 shows an illustration of an activated ignition device, analogously to FIG. 3, with the pulling member pulled out completely.

FIG. 7 shows the ignition device 14 with the pulling member 24 pulled out completely. Since the two halves of the coupling device 42 are no longer fixed at the side by the holder 40, because the coupling device 42 has been pulled completely out of the holder 40, the two halves of the coupling device 42 can fold apart from one another on the film hinge 54 which connects them, thus releasing the cocked firing bolt 36. The firing bolt 36 can now be moved by the loaded spring 38 suddenly downwards against the firing cap 34 in order to activate it. Since the coupling device 42 has now been removed completely from the holder 40, the firing bolt 36 breaks the seal in the base 28. This allows the gases which are created during the combustion of the pyrotechnic effect charge 12 to escape through the broken-through firing cap 34, and through the openings 44 in the bottom part 32, and to pass through the aperture hole (part of which is formed by the holder 40) which holds the firing bolt 36 with the spring 38 in the base 28 of the ignition device 14, and to the outside through the holder 40, which has now been released.

The pyrotechnic signaling means 10 according to the invention can be provided with various pyrotechnic effect charges 12, and is not restricted to pure signaling or smoke charges. In fact, the pyrotechnic signaling means 10 can also be used for illumination purposes, if the at least one pyrotechnic effect charge 12 is in the form of a pyrotechnic flare charge. In addition, the pyrotechnic signaling means 10 according to the invention may also be signaling rockets or parachute signaling rockets. The invention is therefore suitable for all pyrotechnic signaling means 10, with this also being intended to mean, for the purposes of the invention, those which are used for illumination purposes.

List of Designations

10 Pyrotechnic signaling means
12 Pyrotechnic effect charge
14 Ignition device
16 Casing
18 Holder
20 Handle casing
22 Cover
24 Pulling member
25 Relay
26 Thread
28 Base
30 O-ring
32 Bottom part
34 Firing cap
36 Firing bolt
38 Spring
40 Holder
41 Internal area
42 Coupling device
43 Sealing seat
44 Opening
45 Separating plane
46 Operating means
47 Projection
48 Outer section
49 Recess
50 Inner section
52 Cutout
54 Film hinge

What is claimed is:

1. A pyrotechnic signaling device having at least one pyrotechnic effect charge (47) and an ignition device (14), in which the ignition device (14) is activated by a pulling member (24), wherein:

a) the pulling member (24) has sections (48, 50) that are connected to one another in an articulated manner;

b) the sections (48, 50) of the pulling member (24) are folded up by means of articulated connections;

c) the pulling member (24) has at least one associated initiation means for initiating the ignition device (14); and d) at least the articulated connections between the sections (48, 50) are formed by hinged elements.

2. The pyrotechnic signaling means according to claim 1, wherein at least the articulated connections between the sections (48) are designed to allow the pulling member (24) to be unfolded at least partially automatically.

3. The pyrotechnic signaling means according to claim 1, wherein at least one outer section (48) of the pulling member (24) is approximately half as long as at least one inner section (50) of the pulling member (24) located between the outer sections (48).

4. The pyrotechnic signaling means according to claim 1, wherein at least one of the sections (48, 50) of the pulling member (24) is inflexible.

5. The pyrotechnic signaling means according to claim 1, wherein the pulling member (24) has at least one coupling device (42) that is connectable to the initiation means.

6. The pyrotechnic signaling means according to claim 5, wherein the coupling device (42) is detachably connected to the initiation means.

7. The pyrotechnic signaling means according to claim 5, wherein the coupling device (42) is connected to the pulling member (24) in an articulated manner.

8. The pyrotechnic signaling means according to claim 5, wherein the coupling device (42) has at least one projection (47) that is engageable with at least one corresponding recess (49) of the initiation means in order to make a detachable connection between the coupling device (42) and the initiation means.

9. The pyrotechnic signaling means according to claim 5, wherein the coupling device (42) comprises a plurality of parts that are connected to one another in an articulated manner.

10. The pyrotechnic signaling means according to claim 9, wherein the initiation means is releasable by the parts of the coupling device (42) being unfolded when the pulling member (24) is operated.

11. The pyrotechnic signaling means according to claim 5, wherein the ignition device (14) has at least one holder (40) for at least one part of the coupling device (42) on the pulling member (24).

12. The pyrotechnic signaling means according to claim 11, wherein the coupling device (42) seals the ignition device (14) in the holder (40) when the pulling member (24) has not yet been operated.

13. The pyrotechnic signaling means according to claim 1, wherein the pulling member (24) has an operating means (46) that is connected with an outer section (48) of the pulling member (24) in an articulated manner.

14. The pyrotechnic signaling means according to claim 13, wherein the operating means (46) has a cutout (52) for holding at least several sections (48, 50) of the pulling member (24) in a collapsed state.

15. The pyrotechnic signaling means according to claim 1, wherein the pulling member (24) is formed integrally from plastic.

16. A pyrotechnic signaling device having at least one pyrotechnic effect charge (47) and an ignition device (14), in which the ignition device (14) is activated by a pulling member (24), wherein:

a) the pulling member (24) has sections (48, 50) that are connected to one another in an articulated manner, the sections (48, 50) being in the form of strips;

b) the sections (48, 50) of the pulling member (24) are folded up by means of articulated connections to form a compact stack of all the sections (48, 50);

c) the pulling member (24) has at least one associated initiation means for initiating the ignition device (14); and d) at least the articulated connections between the sections (48, 50) are formed by hinged elements.

17. A pyrotechnic signaling device having at least one pyrotechnic effect charge (47) and an ignition device (14), in which the ignition device (14) is activated by a pulling member (24), wherein:

a) the pulling member (24) has sections (48, 50) that are connected to one another in an articulated manner;

b) the sections (48, 50) of the pulling member (24) are folded up by means of articulated connections;

c) the pulling member (24) has at least one associated initiation means for initiating the ignition device (14);

d) at least the articulated connections between the sections (48, 50) are formed by hinged elements; and e) the hinged elements are formed as film hinges.

18. The pyrotechnic signaling means according to claim 17, wherein the film hinges (54) are elastically prestressed for the purpose of at least partially unfolding the sections (48, 50) of the pulling member (24) when said sections (48, 50) are folded up.

* * * * *